United States Patent [19]

Caspe

[11] Patent Number: 4,763,457

[45] Date of Patent: Aug. 16, 1988

[54] SHOCK ATTENUATING BARRIER

[76] Inventor: Marc S. Caspe, 1649 Oakwood Dr., San Mateo, Calif. 94403

[21] Appl. No.: 881,154

[22] Filed: Jul. 2, 1986

[51] Int. Cl.[4] ..... E04B 5/48

[52] U.S. Cl. ..... 52/504; 52/167; 89/36.04

[58] Field of Search ..... 52/503, 504, 505, 227, 52/228, 167; 109/81, 82, 84, 1 S, 49.5; 89/36.04, 36.01; 376/293, 294, 295, 296

[56] References Cited

U.S. PATENT DOCUMENTS

| | | | |
|---|---|---|---|
| 2,704,983 | 3/1955 | Van Dronkelaar | 109/82 X |
| 4,121,393 | 10/1978 | Renault et al. | 52/167 |
| 4,166,344 | 9/1979 | Ikonomou | 52/167 |
| 4,269,011 | 5/1981 | Ikonomou | 52/167 |
| 4,463,872 | 8/1984 | Yellowlees | 52/505 |
| 4,499,694 | 2/1985 | Buckle et al. | 52/167 |
| 4,534,144 | 8/1985 | Gustafsson et al. | 52/167 X |
| 4,543,872 | 10/1985 | Graham et al. | 109/99.5 X |
| 4,610,117 | 9/1986 | Schambeck et al. | 52/227 |

*Primary Examiner*—William F. Pate, III
*Assistant Examiner*—Creighton Smith
*Attorney, Agent, or Firm*—Townsend and Townsend

[57] ABSTRACT

A barrier is constructed from a plurality of cell-like elements interconnected to form a rigid barrier under normal circumstances. The linkages between cells provides a friction-brake force which is exceeded upon application of a traumatic force such as a bomb blast. The linkages includes slots in each cell connecting adjacent cells with prestressed nuts and bolts to permit sliding relative movement between adjacent cells after a predetermined threshold force has been exceeded. A transverse reinforcing rod, having a series of plates along its length, passes through adjacent cells. The plates act as a viscous damper as they move through a filler material within the cells while the rod adds strength. The cells may be coated with a dry lubricant to control the static coefficient of friction. The ability of the cells to move protects the barrier from structural failure by dissipating the blast forces through the frictional work required to displace the cells.

22 Claims, 1 Drawing Sheet

SHOCK ATTENUATING BARRIER

BACKGROUND OF THE INVENTION

The present invention relates to a barrier construction which protects the barrier against damage from truck impact and an explosive blast along the exterior perimeter of a compound.

Perimeter walls provide the barriers which form the first line of defense for protecting enclosures of property. Certain walls must be protected against possible attacks by explosive devices detonated nearby. Conventional walls are rigid and immovable. When blast forces from explosives impact such walls, and the ultimate strength of the wall is exceeded, failure in the form of spalling and fragmentation can result. The flying debris poses a grave danger to humans and property. The subsequent expense of repair or replacement of the damaged wall is also quite burdensome. When a blast destroys a large enough section of the wall to permit intruders to gain entry to restricted areas, the wall's effectiveness as a barrier is compromised. A wall capable of dissipating such forces without being breached or causing potential harm to those nearby would be of great value.

SUMMARY OF THE INVENTION

The present invention provides a system for constructing peripheral walls around a compound or any barrier so that discrete segments of the barrier can be displaced to dissipate the force generated by a blast from a bomb or missile or collision with motor vehicles, such as trucks. The relative movement between segments of the barrier reduce the stress to which the overall structure is subjected during the blast and thereby reduces or eliminates the likelihood that the barrier is destroyed during such an attack. Thus, the present invention protects both the integrity of the barrier against being breached and persons in the compound against injury or possible death from flying fragments of the barrier.

Broadly speaking, the present invention accomplishes this by constructing the barrier from a number of movable wall segments, or cells, which are interconnected to form the wall and designed to move under the force of a severe blast from a bomb. To prevent undesirable movement during the normal use of the wall, the individual segments are mounted so that they are essentially rigid and immovable under normal circumstances until a predetermined minimum threshold force is applied. The linkages between individual cells act as friction brakes which hold the cells in place until a traumatic event such as an explosion occurs. The friction brakes then permit sliding movement between cells so that the barrier can dissipate the forces through the work performed to move the cells against one another. The threshold force is predetermined so that it is well below the force which would cause failure of the barrier structure.

More specifically, the present invention contemplates to construct the barrier from a number of similar cell elements, each having a hollow portion into which is set a filler such as, for example, gravel or sand or the like. The wall is constructed by interconnecting the cells in an arrangement in which the cells are vertically and horizontally adjacent to one another. For purposes of this application and the appended claims, the term "filler" will be used to refer to all possible materials which may be placed inside the individual bricks for additional weight and strength, and the term "cell" will be used to refer to the individual elements, unless otherwise indicated. Once installed, the individual cells containing the filler are movable relative to each other upon applicatin of at least a minimum threshold force.

Each cell is constructed to provide a stackable geometric shape for defining the barrier structure. Preferably, each of the cells are similar in size and shape so as to be interchangeable. Further, the parts linking the individual cells are also identical and interchangeable. Specially shaped cells for corners or curved walls are also contemplated.

In the preferred embodiment, the cells are generally rectangular blocks with interconnecting portions and a central hollow portion for containing the filler. The cells are constructed from a smooth-surfaced material, preferably low carbon mild steel. Further, the material should be relatively high in strength to withstand a significant amount of force before beginning to move at the application of the threshold force to absorb the impact of the blast forces. Also, the material of construction must be able to withstand the ravages of weather, be resistant to oxidation, and have a low coefficient of thermal expansion to limit swelling or shrinkage which might impede the movement of the cells. Such expansion and contraction movements along the length of the wall are permitted by spacing each cell from its adjacent cell by the thickness of the dry lubricant and stainless steel surfaces defined below.

To assist the relative movement of the cells, certain of the contacting surfaces of the blocks and of the linkage elements are coated with a lubricant. Preferably, a high friction dry lubricant, such as tetrafluoroethylene or G-12®, sliding on stainless steel is used. In the preferred embodiment, slots are arranged along the cells, disposed in the direction in which movement is desired, with the dry lubricant and stainless steel surfaces in narrow strips along the slotted holes. Adjacent slots are connected by bolts with nuts in a conventional fashion. Slide plates provided with lubricant coated surfaces are placed between the interior cell walls and the nuts to assure that relative movement is permitted, and to establish a known and repeatable static coefficient of friction, which must be overcome to initiate relative movement along the slots. The holding force applied to the cells by the nut and bolt arrangement can be predetermined to adjust the blast force needed to cause slippage between cells of the barrier.

Further energy dissipation can be attained by the insertion of a reinforcing rod or cable running transversely to the axes of the cells and through the filler material in the middle chambers. The rod has a number of shaped plates welded along its length. The plates are arranged perpendicular to the axis of the rod and are surrounded by the filler in the chambers. As the plates and rod are pulled through the filler, heat is generated and more of the wall's adjacent mass is engaged in absorbing the energy of the blast.

The present invention provides a protective barrier which dissipates the sudden blast force generated by an explosion. The wall is designed to perform work to dissipate the blast forces by moving individual cells. When a blast occurs, each cell subjected to a differential force between it and its adjacent cell equal to or greater than the threshold force predetermined to be safe for the wall, moves opposite and away from the force and is pushed to an extent which depends on the magnitude and duration of the force. Through the proper calculation of the threshold force level, damage to the barrier or the dangerous disintegration thereof, which jeopardizes humans or property near the wall, is prevented. The threshold force may be varied according to the location of the cell. After the blast, it is relatively simple and inexpensive to unbolt the bolts and move the individual wall elements back to their normal, plumb position, typically with the help of mechanical devices.

DESCRIPTION OF THE PREFERRED EMBODIMENT

Figure 1:
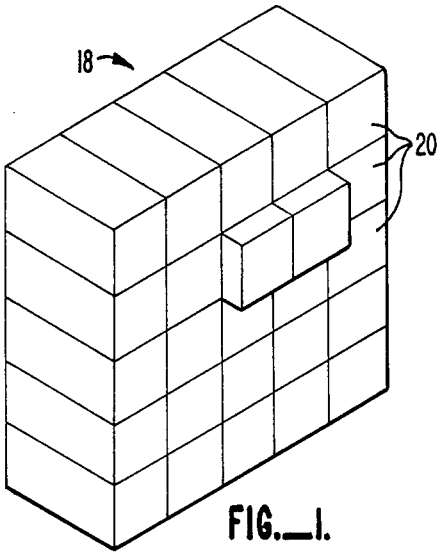
FIG. 1 is a simplified isometric view of a barrier constructed in accordance with the present invention, with a portion of the wall shown being deflected by an explosion.

A typical barrier constructed in accordance with this invention is illustrated in FIG. 1. It is to be understood that the barrier may be constructed in any desired configuration. FIG. 1 illustrates a wall suitable for use as a perimeter barrier for protecting an individual building or an enclosure of buildings or equipment or troops. The exterior appearance of the wall may be customized architecturally so as to give the appearance of a conventional wall construction and to provide corrosion protrusion.

The barrier 18 is constructed of numerous elements, or cells 20, which are interlinked to form the normally rigid barrier. Under normal conditions, the linkages between cells act as friction brakes to hold the barrier rigid. Under stress conditions, such as a bomb explosion in the vicinity of the barrier, or the impact of projectiles against the barrier, the linkages of the barrier allow relative movement between the cell elements, under control of the "friction brakes." Such movement permits some of the energy from the blast to be dissipated in the friction work performed by the moving elements of the barrier, and some energy to be absorbed by the motion of the barrier structure. It is the goal of this invention to create a barrier which permits slippage so that it does not suffer structural failure once its ultimate strength is exceeded. Such failure causes danger to nearby persons due to barrier fragmentation and could result in the breaching of conventional barrier systems.

Figure 1A:
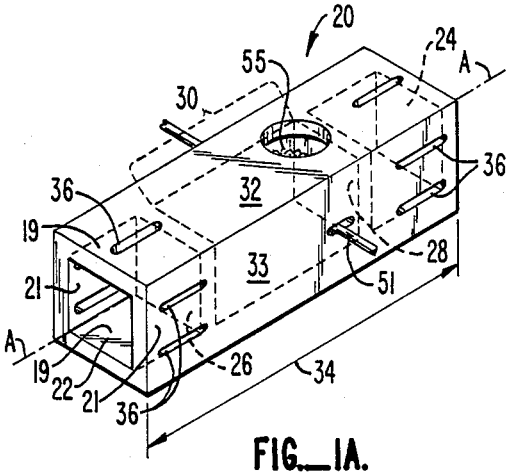
FIG. 1A is an isometric view of a typical cell.
Figure 2:
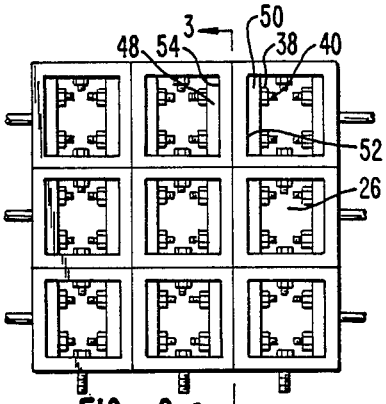
FIG. 2 is a front view of a typical barrier section including nine cells.

In the preferred embodiment, each cell is a generally rectangular metal block 20 as shown in FIG. 1A. For ornamental purposes, the cells may be formed into any geometry suitable for stacked arrangements into a barrier structure. Each cell or block 20 is shown as identical in shape, although cells for special locations such as corners or curved areas may be of a different shape.

In general, cells are interchangeable to reduce cost. The basic cell shown in FIG. 1A consists of a hollow, tubular block 20 having horizontal and vertical walls 19, 21 and open ends 22 and 24. Block 20 has a rectangular cross-section taken perpendicular to its longitudinal axis A—A. Two panels 26 and 28, spaced apart form the open ends 22 and 24, respectively, define a central hollow region 30. Panels 26 and 28 also serve to reinforce the tubular construction's rigidity. Block 20 itself is constructed preferably by welding low carbon mild steel, which has a high yield strength and ductility.

The basic cells 20 are stacked together along their longitudinal wall surfaces 32, 33 to form barrier 18. The length 34 of the cells thus defines the depth, or thickness of barrier 18 constructed from the blocks.

Figure 3:
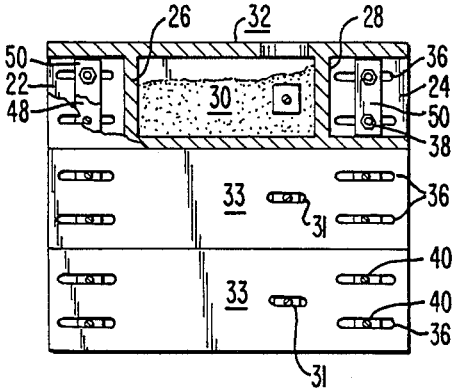
FIG. 3 is a fragmentary, cross-sectional view of the wall taken along the line 3—3 of FIG. 2.

As shown in FIGS. 1A and 3, a series of longitudinal slots 36 are formed through walls 19, 21 between each open end 22, 24 and its nearest respective panel 26, 28. Slots 36 on the top, bottom and side surfaces of the cells are the guide tracks for the linkages between adjacent blocks. Slots 36 are arranged parallel to the longitudinal axis A—A of block 20 so that longitudinal movement between adjacent blocks is made possible. Slots 36 have a length calculated to accommodate the maximum displacement anticipated between cells.

Figure 4:
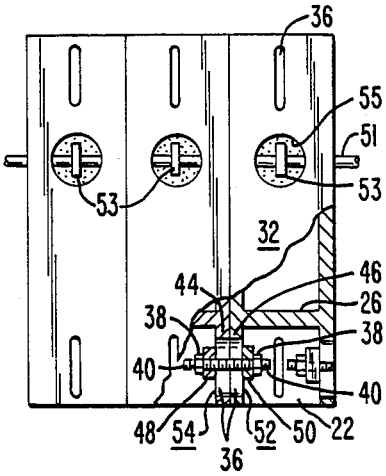
FIG. 4 is a cutaway detailed view of a linkage between two adjacent barrier cells.

Adjacent cells 20 are joined by a nut 38 and a bolt 40 as shown in FIG. 4, passing through aligned slots 36. The two adjacent cell wall portions 44 and 46 of vertical walls 21 are sandwiched between the two nuts 38 threaded onto bolt 40. One of the interfacing cell wall surfaces 33 may be coated with a strip of dry lubricant and the other with a strip of stainless steel, to facilitate sliding between the contacting surfaces.

Additionally, slide plates 48 and 50 constructed of stainless steel with lubricant coated strips on its surfaces are provided between each nut 38 and the inner wall surfaces 52 and 54 of wall portions 44, 46 to facilitate control over the relative movement between the bolts 40 and the blocks, and to prevent the shearing of the bolts 40. Tetrafluoroethylene, also known as Teflon ®, or a lubricant, also known as G-12 ® as manufactured by the Merriman Corporation of Hingham, Mass., have proven to be satisfactory lubricants. As can best be seen in FIG. 3, slide plates 52, 54 are oriented perpendicular to slots 36 formed in vertical wall portions 44, 46 of both cells 20.

The linkages between the blocks 20 are adjustable at the nuts 38 and bolts 40 by applying a prestress force or torque so that the threshold force required to initiate relative movement of a portion of the barrier 18 may be predetermined by multiplying the bolt tensile force by the friction coefficient. The barrier 18 may be constructed so that the structure has a higher threshold force in some areas relative to other areas. The nuts 38 may be prestressed during installation of the cells 20 to the desired holding force.

To permit the maximum longitudinal movement of the blocks 20 in either of two longitudinal directions, the bolts 40 are installed midway along the length of slots 36.

To increase the mass and stability of the barrier 18, the hollow regions 30 are filled with a filler material such as sand or gravel. A rod 51 passes transversely through the sand filled chambers of adjacent blocks, and a plurality of shaped plates 53 are welded to it centrally, in the field, through the top handholes 55. The rod 51 is threaded through adjacent blocks transverse to the longitudinal axes of the individual blocks through the slots 31. The small shaped plates 53 spaced along the length of rod 51 are arranged such that at least one plate is within the hollow chamber of each block. Thus, the rod 51 and plates 53 act as a viscous damper through the filler material when movement begins. Access openings such as top handhole 55 permit the shaped plates 53 to be welded to the rod 51. The openings can then be sealed in a conventional manner.

The increased mass of the barrier 18, along with the ultimate strength and reinforcement afforded by the individual steel cells, increases the barrier's ability to absorb the forces generated by explosives and projectiles up to the threshold force of the barrier.

As the threshold force is reached and exceeded, the blast forces are then permitted to attenuate while the blocks move in a controlled fashion along their linkages. In this way, the ultimate strength of the barrier components is not exceeded—which would lead to structural failure and disintegration. Once the stressful event is over and danger has passed, the wall or barrier may be realigned by either loosening the linkage means and repositioning the blocks before rebolting or simply by jacking the cells back into the normal position.

The barrier 18 is constructed by arranging the lowermost layer of blocks 20 in their adjacent positions. As the blocks are stacked horizontally, the slots of adjacent block surfaces are aligned. The nuts 38, bolts 40 and slide plates 48 and 50 are then positioned relative to the slots. The linkages are then prestressed to the desired threshold force. Once a barrier level is constructed, the rod, shaped plates and filler material may be applied. The subsequent layers of blocks 20 are arranged above the lower layer, and linkages within the layer and between the two layers are prestressed. The barrier is then in a completed state and ready for reducing the impact of trucks and/or explosives.

The foregoing is a complete description of the invention, but is not intended to limit the scope of the invention, except as stated in the appended claims. While the above provides a full and complete disclosure of the preferred embodiment of the invention, various modifications, alternate constructions and equivalents may be employed without departing from the true spirit and scope of the invention. For example, the embodiment described herein and shown in the drawings disclose cells with a rectangular-shaped cross-section. Cells with circular, triangular or other polygonic cross-sections would be equally suitable. Also, the slots of the linkage means might also be provided with a lateral dimension to permit movement of the cells in other than the longitudinal direction. The slide plates of the linkages might be eliminated and replaced with spring-like members, bending members or hydraulic means to compensate for metal expansion and contraction due to temperature changes. The headless bolts could be replaced with bolts having heads so that only a single nut per linkage would be needed. Conventional fasteners other than nuts and bolts might also be used. Therefore, the above description and illustrations should not be construed as limiting the scope of the invention which is defined by the claims.

What is claimed is:

1. A shock attenuating barrier, comprising:

a plurality of cells, said cells shaped to be stackable adjacent to one another to form a barrier, wherein each of the cells comprises a tubular block having a longitudinal axis, a continuous peripheral wall, a uniform rectangular cross-section, and open ends; and at least one bulkhead panel, disposed within the interior of said block, arranged perpendicular to said longitudinal axis, said panel spaced apart from each open end of said block; and means for linking said cells, wherein said linking means rigidly connects said cells in a normal position occupied by said cells under normal circumstances, and wherein said linking means permits relative sliding movement between adjacent cells upon application of a threshold force.

2. The barrier of claim 1, wherein said linking means comprises:

longitudinally disposed slots along said peripheral wall of said block, said slots disposed between each said open end and the nearest panel;

a bolt passing through a pair of aligned slots of two adjacent blocks;

a nut threadably engaging said bolt; and a slide plate, disposed between an interior wall of said block and said nut, said slide plate further comprising a lubricant coated surface to facilitate relative movement between said block and said bolt.

3. The barrier of claim 2, wherein said linking means is pre-stressed during construction of the barrier.

4. The barrier of claim 1, wherein said cells are constructed of mild steel.

5. A shock attenuating barrier, comprising:

a plurality of cells, said cells shaped to be stackable adjacent to one another to form a barrier; and means for linking said cells, wherein said linking means rigidly connects said cells in a normal position occupied by said cells under normal circumstances, and wherein said linking means permits relative sliding movement between adjacent cells upon application of a threshold force, wherein each said cell further comprises a hollow region containing a filler material and a viscous damper threaded transversely through said filler material of said blocks.

6. The barrier of claim 5, wherein said viscous damper comprises a rigid rod passing transversely through at least two of said cells, and further comprising perpendicular plates spaced along said rod to resist movement through said filler material.

7. A shock attenuating barrier, comprising:

a plurality of cells, said cells being substantially rigid and shaped to be stackable adjacent to one another to form a barrier, wherein said cells include outer cell surfaces in contact with outer cell surfaces of adjacent cells, and further comprising a surface coating of high friction dry lubricant between the contacting outer cell surfaces to facilitate relative movement between adjacent plates; and linking means, said linking means rigidly connecting said cells in a normal position occupied by said cells under normal circumstances and permitting relative sliding movement between adjacent cells upon application of a threshold force to at least one of the cells.

8. The barrier of claim 7, further comprising:

a hollow chamber formed in said cells; and a filler material within said hollow chambers.

9. The barrier of claim 8, wherein said barrier further comprises a rod slidably passing through said hollow chambers of adjacent cells.

10. A shock attenuating barrier, comprising:

a plurality of cells, said cells shaped to be stackable adjacent to one another to form a barrier;

means for linking said cells, wherein said linking means rigidly connects said cells in a normal position occupied by said cells under normal circumstances, and wherein said linking means permits relative sliding movement between adjacent cells upon application of a threshold force;

wherein said cells include outer cell surfaces in contact with outer cell surfaces of adjacent cells, and further comprising a surface coating of high friction dry lubricant between the contacting outer cell surfaces to facilitate relative movement between adjacent plates;

a hollow chamber formed in each of said cells;

a filler material within said hollow chambers;

a rod slidably threaded through said hollow chambers of adjacent cells; and wherein said rod further comprises plates disposed along said rod perpendicular to the longitudinal axis of said rod, wherein said plates are enclosed by the filler material of said hollow chamber of each cell.

11. The barrier of claim 10, wherein said outer cell surfaces further comprise access holes opposite said plates disposed along said rod.

12. The barrier of claim 10, wherein said filler material is sand.

13. The barrier of claim 10, wherein said filler material is gravel.

14. A shock attenuating barrier, comprising:

a plurality of blocks forming the barrier, each said block having a tubular form and two open ends, with longitudinal walls, a uniform rectangular cross-section, and at least two panels disposed within the interior of each said block, each said panel disposed perpendicular to a longitudinal axis of said block and spaced apart from each open end of said block; and means for linking said blocks to rigidly connect said blocks under static conditions and to permit relative sliding movement between adjacent blocks upon application of a threshold force to said barrier, said linking means comprising:

longitudinally disposed slots in the walls positioned for alignment with the slots in the walls of adjacent blocks; and means, passing through said aligned slots, for slidably joining said blocks.

15. The barrier of claim 14, wherein said slidably joining means comprises bolts passing through the aligned slots and adjustably affixed with nuts.

16. The barrier of claim 15, wherein said engagement means further comprises a slide plate disposed between the interior of said longitudinal wall and said nut having surfaces facing the nut and the wall interior coated with a high friction dry lubricant.

17. The barrier of claim 14, wherein said blocks further comprise hollow chambers filled with a filler material and said linking means further comprises a transverse rod passing through the hollow chambers of adjacent blocks through said longitudinal walls of said blocks, said transverse rod further comprising plates perpendicular to the longitudinal axis of the rod such that said plates are within said hollow chambers.

18. The barrier of claim 17, wherein said longitudinal walls of each of said blocks further comprise an access opening adjacent said rod for welding said fixed plates.

19. A block for forming a shock attenuating barrier, comprising:

a tubular cell, having a uniform cross-section and open ends;

two panels, one spaced apart from either end of said cell, disposed perpendicular to a longitudinal axis of said cell;

longitudinal walls of said cell having slots which are longitudinally disposed between either open end of said cell and the nearest adjacent panel, said slots aligning with slots of adjacent cells of the barrier;

a hollow chamber formed by said panels and said longitudinal walls;

means for slidably and adjustably engaging said slots of two adjacent cells; and slide plates disposed along said engaging means, said slide plates further comprising a lubricated surface along which said cell can slide relative to said engaging means.

20. The block of claim 19, further comprising openings along said longitudinal walls for accepting a rod passing through adjacently stacked blocks.

21. The block of claim 20, wherein said rod further comprises a series of spaced plates, wherein each said washer plates is welded to be located within said hollow chamber of each said block.

22. The block of claim 21, wherein said block further comprises access openings along its wall surfaces for access to said rod and said plates.

* * * * *